US005370599A

United States Patent [19]

Marque et al.

[11] Patent Number: 5,370,599

[45] Date of Patent: Dec. 6, 1994

[54] TERMINATING CENTRIFUGATION ON THE BASIS OF THE MATHEMATICALLY SIMULATED MOTIONS OF SOLUTE BAND-EDGES

[75] Inventors: Jeffrey J. Marque, San Mateo, Calif.; Allen P. Minton, Bethesda, Md.; Paul J. Voelker, Fremont, Calif.

[73] Assignee: Beckman Instruments, Inc., Fullerton, Calif.

[21] Appl. No.: 42,359

[22] Filed: Apr. 2, 1993

[51] Int. Cl.[5] ..... B04B 13/00

[52] U.S. Cl. ..... 494/37; 494/7; 494/10; 494/11; 364/502

[58] Field of Search ..... 494/1, 7, 10, 11, 16, 494/20, 37, 84, 85; 210/781, 782; 364/502, 578; 422/72

[56] References Cited

U.S. PATENT DOCUMENTS

| | | | |
|---|---|---|---|
| 3,009,388 | 11/1961 | Polanyi | 494/11 X |
| 4,244,513 | 1/1981 | Fayer et al. | 494/11 X |
| 4,285,810 | 8/1981 | Kirkland et al. | 494/7 X |
| 4,941,868 | 7/1990 | Chulay et al. | 494/37 |
| 5,171,206 | 12/1992 | Marque | 494/37 |

OTHER PUBLICATIONS

Publication entitled "Computer Derived Rotor Speed Protocols for in situ Control of Local Solute Concentration during Centrifugation", Proceedings of the 112th Annual Meeting of the American Society of Mechanical Engineers, BED-vol 21, Bioprocess Engineering Symposium, Book No. H00726-1991, pp. 9-13, 1991.

*Primary Examiner*—David A. Scherbel
*Assistant Examiner*—Charles Cooley
*Attorney, Agent, or Firm*—William H. May; P. R. Harder; Gary T. Hampson

[57] ABSTRACT

A method of controlled centrifugation including automatic determination (before or during a centrifugation run) of the time to reach "completion" (within specified limits, depending on the criteria adopted) of a centrifugal separation. By simulation, the sample solute concentration distributions are determined and examined periodically. Centrifugation completion is deemed to have been reached based on certain predetermined criteria relating to spatial changes in the sample solute concentration distributions between successive examinations. The positions of the end points of the concentration distributions or band edges of the sample solutes (transitions from regions of sample solutes to regions of no sample solutes) are determined to facilitate resolving spatial changes of the concentration distributions. The position of an end point or band edge is characterized by a specific location along the centrifuge tube where an imaginary boundary exists at which no more than a specific % of the total mass of the solute in the band lies outside said boundary. In order to avoid premature termination of centrifugation before actual equilibrium has been reached as a result of excessive frequent checks of the motion of the concentration distribution because of relatively long time scale in sedimentation, an estimate is provided of a characteristic periodic interval between successive checks of sample solute concentration distributions.

8 Claims, 6 Drawing Sheets

TERMINATING CENTRIFUGATION ON THE BASIS OF THE MATHEMATICALLY SIMULATED MOTIONS OF SOLUTE BAND-EDGES

BACKGROUND OF THE INVENTION

1. Field Of the Invention.

The present invention relates to centrifugation and more particularly to the execution of centrifugation in a controlled manner by simulation analysis.

2. Description of Related Art

Essentially, centrifugation is a process for separating particles suspended in a solution. In biological applications, the particles are usually macromolecules, cells, DNA fragments, etc. The device used for centrifugation is a centrifuge which includes a rotor that supports several containers (e.g. centrifuge tubes) of sample solution for rotation about a common axis. As the rotor spins in the centrifuge, centrifugal force is applied to each particle in the sample solution and each particle will sediment at a rate which is proportional to the centrifugal force applied. The viscosity of the sample solution and the physical properties of the particle also affect the sedimentation rate of each individual particle. The sedimentation speed of the particle is proportional in part to its shape and size (molecular weight), and to the ratio of the particle and solution densities.

One of the many methods of centrifugal separation is by density gradient centrifugation, which permits the complete separation of several or all of the components in a mixture according to their buoyant densities. The density gradient method involves a supporting column of "density gradient" fluid whose density increases toward the bottom of the tube. The density gradient fluid consists of a suitable low molecular weight solute dissolved in a solvent in which the sample particle mixture can be suspended.

In using the centrifuge to purify circular DNA plasmids, geneticists and molecular biologists frequently use an isopycnic separation technique. In this technique, both circular (desirable) and non-circular (non-desirable contaminant) DNA plasmids are saturated with ethidium bromide and then suspended in a concentrated solution of cesium chloride (CsCl). High speed centrifugation of the suspension results in the formation of a CsCl concentration gradient (and hence density gradient), and separation of the relatively dense circular DNA from the relatively light non-circular DNA/ethidium bromide complexes in the density gradient. Each particle will sediment or float toward a position in the centrifuge tube at which the gradient density is equal to its own buoyant density, and there it will remain in equilibrium. The isopycnic technique, therefore, separates particles into zones or bands on the basis of their buoyant density differences.

An important consideration in designing and executing such centrifugation separations is the need to prevent excessive sedimentation of the dissolved CsCl, which can lead to CsCl crystallization at the tube bottom and consequent excessive local rotor stress levels. In U.S. Pat. No. 5,171,206 (assigned to the assignee of the present invention and incorporated by reference herein), and also in "Computer Derived Rotor Speed Protocols for in situ Control of Local Solute Concentration during Centrifugation", Proceedings of the 112th Annual Meeting of the American Society of Mechanical Engineers, BED-Vol. 21, Bioprocess Engineering Symposium, Book. No. H00726-1991, pp. 9–13, a method of obtaining optimal centrifugal separation subject to the CsCl crystallization constraint is disclosed. Such method can be used in plasmid separations and allows a computer on board the centrifuge to calculate the solute distributions and the rotor speed vs. time protocol that absolutely maximizes rotor speed, subject to the constraint that CsCl crystal formation is forbidden. The method involves the numerical integration of the partial differential equation of sedimentation-diffusion (the Lamm equation) for three solutes (CsCl, circular DNA and non-circular DNA) while the simulated rotor speed is subject to the constraint that there be no change in the CsCl concentration at the tube bottom upon reaching saturation (i.e., the solubility limit). The aforementioned numerical integration gives, as outputs, the optimized rotor speed as a function of time, and the solute concentrations as a function of space and time. A characteristic of the aforementioned simulation method is that it has no natural simulation endpoint. Left to its own device, it will continue indefinitely to determine solute concentrations as functions of space and time, and rotor speed as a function of time, even though the concentrations and rotor speed asymptotically approach limits. For the optimization method to be practical, therefore, some other method needs to be invoked concurrently that periodically checks the status of the simulated run and tells the computer when the simulated DNA separation is complete, at least within specified limits.

SUMMARY OF THE INVENTION

The present invention is directed to controlled centrifugation including automatic determination (before or during a centrifugation run) of the time to reach "completion" (within specified limits, depending on the criteria adopted) of a centrifugal separation. By simulation, the sample solute concentration distributions are determined and examined periodically. Centrifugation completion is deemed to have been reached based on certain predetermined criteria relating to spatial changes in the sample solute concentration distributions between successive examinations.

The positions of the end points of the concentration distributions or band edges of the sample solutes (transitions from regions of sample solutes to regions of no sample solutes) are determined to facilitate resolving spatial changes of the concentration distributions. The position of an end point or band edge is characterized by a specific location along the centrifuge tube where an imaginary boundary exists at which no more than a specific % of the total mass of the solute in the band lies outside the boundary. In order to avoid premature termination of centrifugation before actual equilibrium has been reached as a result of excessively frequent checks of the motion of the concentration distribution because of the relatively long time scale in sedimentation, an estimate is provided of a characteristic periodic interval between successive checks of sample solute concentration distributions.

The criteria to be adopted may be one or more of the following depending on the particular centrifugation methodology chosen: (a) substantially no change in the position of the end points of one or more sample solute concentration distributions between successive checks; (b) substantially no change in the width of one or more of the sample solute concentration distributions between successive checks, i.e. distance between the end points of a concentration distribution; and (c) substantially no change in the distance between adjacent end points of adjacent sample solute concentration distributions between successive checks.

DESCRIPTION OF THE ILLUSTRATED EMBODIMENTS

The following description is of the best presently contemplated mode of carrying out the invention. This description is made for the purpose of illustrating the general principles of the invention and should not be taken in a limiting sense. The scope of the invention is best determined by reference to the appended claims.

The following description of the present invention will be referenced to DNA plasmid separation in which circular and non-circular DNA plasmids are separated into two zones upon centrifugation. It is to be understood that the present invention is applicable to other types of sample solutes. To simplify the description of the present invention, the centrifuge tube used is a cylindrical test tube oriented with its axis horizontal during centrifugation in a swinging bucket rotor. The analysis below can be applied to centrifuge tubes of other geometries and orientations, as well as other types of rotors.

Figure 1:
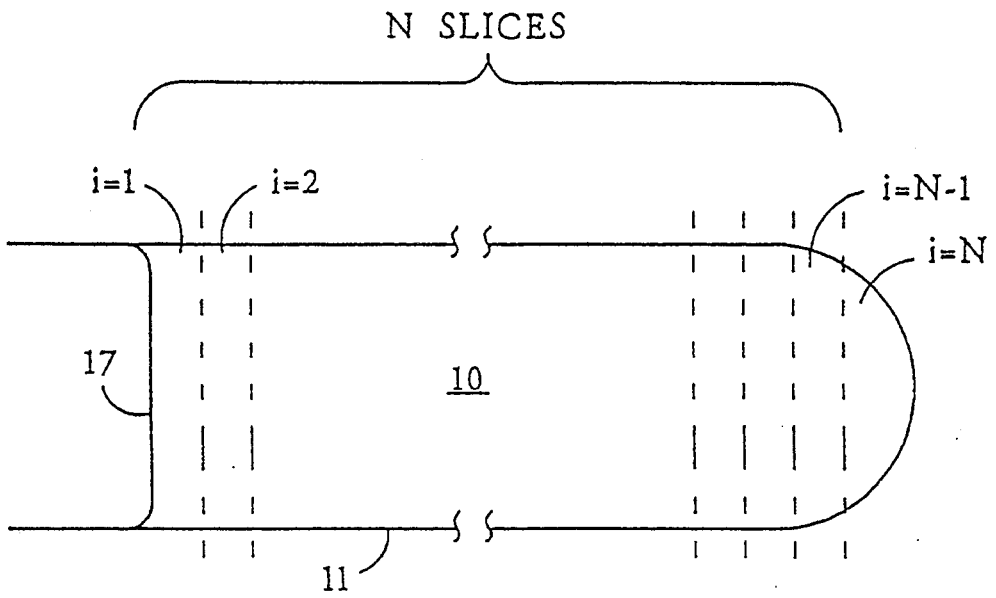
FIG. 1 is a diagram illustrating the mathematical division of a centrifuge tube to aid in the description of the numerical analysis of the present invention.

The numerical integration technique for determining CsCl and DNA plasmid solute distributions upon centrifugation is summarized below. Reference can also be made to U.S. Pat. No. 5,171,206 to Marque or U.S. Pat. No. 4,941,868 to Chulay et al., which are incorporated by reference herein. Referring to FIG. 1, the solution 10 in a centrifuge tube 11 is divided into N slices beginning from the meniscus 17 of the solution. N can be any integer number, the value of which will determine the accuracy of the calculation and the computation time required. Each slice has a finite thickness and volume and is separated from adjacent slices by imaginary boundaries indicated by dashed lines. The governing equation for sedimentation and diffusion of any solute (e.g. CsCl circular and non-circular DNA plasmids) is a well known precursor of the Lamm equation:

$$J_{i-1,i}=sW^2r_{i-1,i}\overline{C_{i-1,i}}-D\nabla C_{i-1,i}$$

where $i=1, \ldots, N$; $J_{i-1,i}$ is the flux, or time rate of passage of particles per unit area across the boundary separating the (i−1)th and ith slices; s is the local sedimentation coefficient of the particles; W is the angular velocity of the rotor; $r_{i-1,i}$ is the radial distance of the boundary separating the (i−1)th and ith slices measured from the axis of rotation; $\overline{C_{i-1,i}}$ is the average concentration of particles in the (i−1)th and ith slices (expressed as number of particles per unit volume); D is the diffusion coefficient for the particles which depends on the size and shape of the particles, the viscosity of the solution and the temperature; and $\nabla C_{i-1,i}$ is the "gradient" of the concentration of particles at $r_{i-1,i}$.

Figure 3:
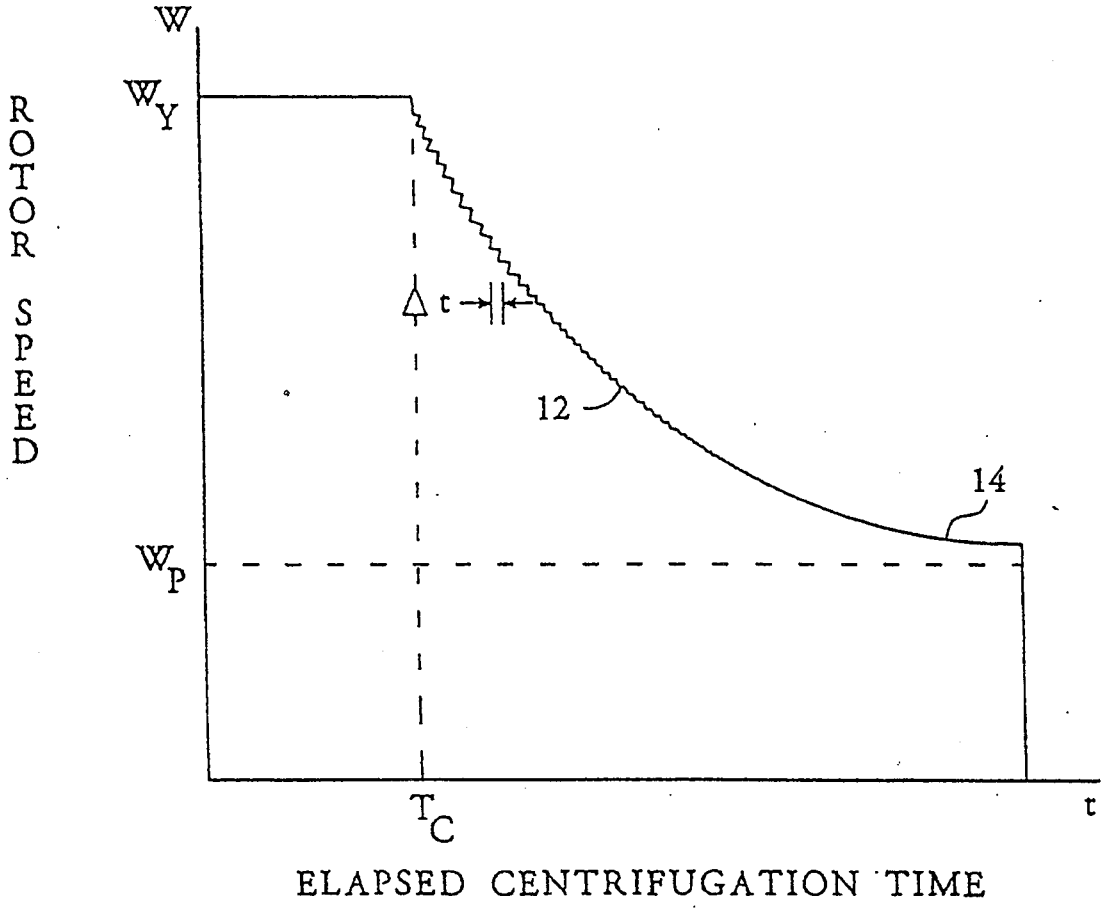
FIG. 3 is a graph showing rotor speed vs. elapsed time for continuous rotor speed control.
Figure 2A:
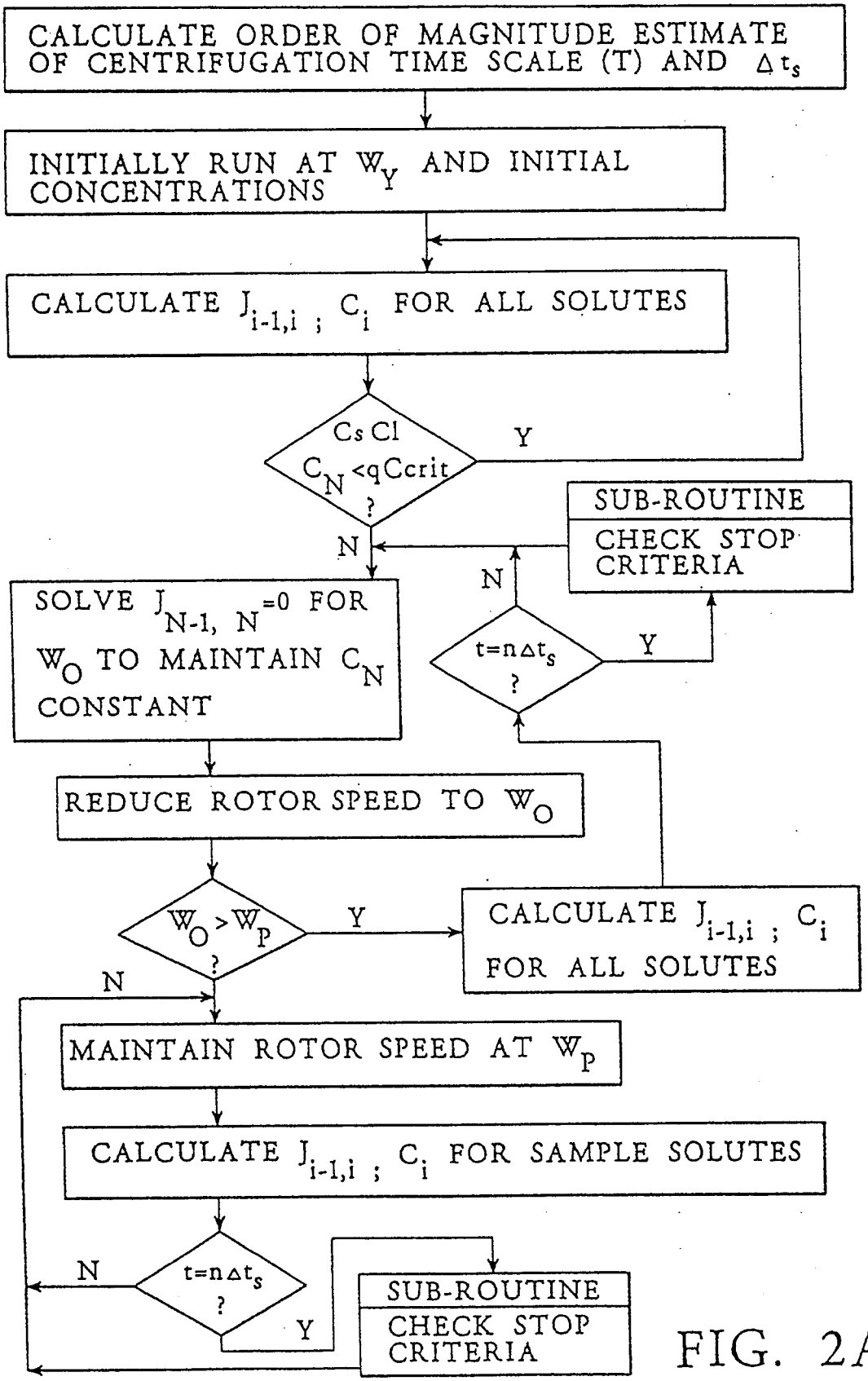
FIG. 2A is a flow diagram of rotor speed control in accordance with the present invention.
Figure 2B:
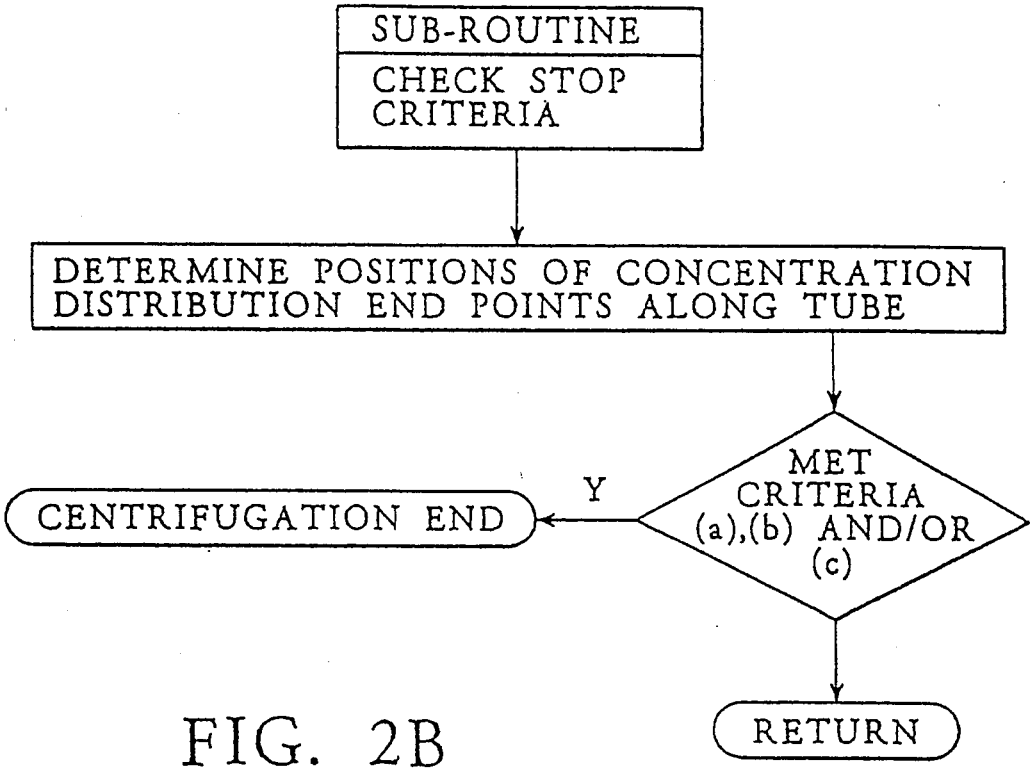
FIG. 2B is a flow diagram of the solute separation status check in accordance with the present invention.

The method for determining the optimal rotor speed that will result in the shortest amount of time required for density gradient separations has been disclosed in U.S. Pat. No. 5,171,206 which has been incorporated by reference herein. Referring to FIGS. 2A and 2B centrifugation is started at the maximum speed $W_y$ permissible for the particular rotor and average density of the solution. The maximum speed $W_y$ is determined from rotor yield stress specifications provided by the rotor manufacturers. Centrifugation is continued at that speed until the time $t=T_c$ when the concentration $C_N$ of the gradient salt, e.g. CsCl, in the bottom of the tube reaches the critical precipitation threshold value $C_{crit}$ or a value within a desired margin of safety ($q\times C_{crit}$ where $0<q<1$, and in practice q is close to 1). The speed $W_o$ that is required to make the flux $J_{N-1,N}$ into the bottom (Nth) slice equal to exactly zero (i.e. $C_N$ will not increase beyond $C_{crit}$) is then calculated. The rotor speed is then reduced to this new speed $W_o$ thereby keeping the CsCl concentration in the bottom slice $C_N$ at or below (close to) the critical precipitation threshold value $C_{crit}$. At each iteration thereafter, the rotor speed is similarly calculated and reduced so as to maintain the concentration $C_N$ in the bottom slice at or below (close to) precipitation concentration $C_{crit}$ for all times after $T_c$. The change in the rotor speed with time required to maintain close to critical concentration is best illustrated by line 12 in FIG. 3. The rotor speed is maintained as close as is practical to the critical speed limit; higher speeds would cause precipitation of the gradient material. The smoothness of the curve will depend on the frequency of successive iterations. In theory, a smooth line 14 can be obtained using a large N value and high resolution processors. $W_P$ represents the rotor speed at which precipitation will never occur for an indefinite period of time for a particular loading density.

The steps for obtaining concentration distributions of the sample solutes will now be described. The computer algorithm associated with these steps, however, will not be described since it is merely an exercise of computational programming skills involving conventional numerical computation techniques. A portion of the algorithm is substantially similar to the algorithm used in U.S. Pat. No. 4,941,868 and U.S. Pat. No. 5,171,206, commonly assigned to the assignee of the present application, for transient analysis of centrifugal separation.

The relevant portions of said applications are incorporated by reference herein.

Given the initial concentrations of the CsCl and DNA plasmids solutes in each slice, the initial rotor speed $W_y$ consistent with rotor yield stress constraint for the particular average fluid density, and the diffusion and sedimentation constants, the flux $J_{i-1,i}$ across each boundary at each distance $r_{i-1,i}$ of all the solutes can be calculated. As is consistent with finite difference approximation, $\nabla C_{i-1,i}$ is approximated as the difference of the concentrations ($C_{i-1}$,$C_i$) across adjacent slices divided by a distance measured between the centers of the slices, which in the case of slices of equal thickness equals the thickness of a slice. For initial concentrations in each slice, the simplest example will be the case where the concentrations are the same for each slice as in the case of a homogenous self-forming density gradient solution, e.g. cesium chloride (CsCl).

The total number of particles of a particular solute (i.e. CsCl, circular and non-circular DNA plasmid) that travel across each boundary during the period $\Delta t$ is then simply given by:

$$J_{i-1,i} \cdot A_{i-1,i} \cdot \Delta t$$

where $A_{i-1,i}$ is the area of the boundary between the (i−1)th and ith slices. In the case of the test tube in the example shown in FIG. 1, this area will be the same for all boundaries except for the slices near the bottom of the tube. The total number of particles residing in a particular slice after period $\Delta t$ will be given by {the number of particles originally present} plus {the net number of particles flowing into that slice}. Since the geometry and thus the volume of the slice is known, the new concentration $C_i$ after period $\Delta t$ is given by the total number of particles in the slice divided by the slice volume.

By obtaining the flux at each and every one of the boundaries and subsequently applying the just described steps for calculating the concentrations, one can obtain the new concentration values of a given solute at any time t and for any slice i, thereby modeling the concentration distributions of the particles, including CsCl, circular and non-circular DNA plasmids.

The same calculations are repeated after each period $\Delta t$. Each iteration, the concentration values $C_i$ obtained for the preceding $\Delta t$ period are used to obtain the flux values for the current $\Delta t$ period which in turn are used to obtain a new set of concentration values. This iterative process continues until the stop criteria in accordance with the present invention has been met.

In accordance with the present invention, the stop criteria is based on the spatial characteristic of the sample solute concentration distributions. By simulation, the sample solute concentration distributions are determined and examined periodically (not necessarily at the same frequency as the flux determination). Centrifugation completion is deemed to have been reached based on certain predetermined criteria relating to spatial changes in the sample solute concentration distributions between successive analysis of solute concentration distributions.

Reference is made to FIGS. 4–6 which schematically illustrates the sequence of changes in the concentration distributions $C_i$ of circular and non-circular DNA solutes in CsCl gradient fluid. Specifically, the plots show the concentrations of CsCl, circular DNA and non-circular DNA as a function of location along the centrifuge tube 11 (expressed as slice number i; see FIG. 1) at a particular elapsed time from a reference start time. Referring to FIGS. 4–6 and also to FIG. 1, the meniscus 17 of the solvent 10 in the centrifuge tube 11 is the left-most location (i=0) of the solvent 10 closest to the rotor spin axis, and the tube bottom is the right-most location (i=N) of the solvent furthest from the rotor spin axis.

Figure 4A:
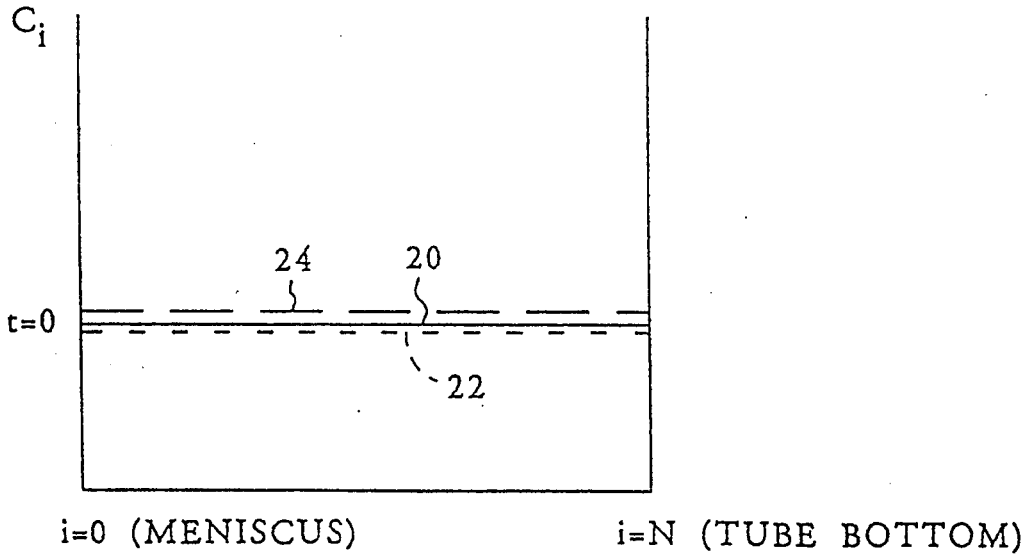
FIG. 4A is a plot illustrating the simulated concentration distributions of the sample solutes (circular and non-circular DNA plasmids) and CsCl at the inception of centrifugation.
Figure 4B:
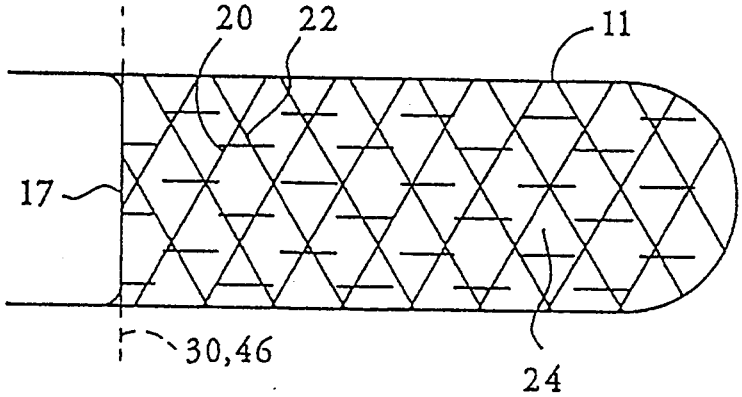
FIG. 4B is a schematic illustration of the appearance of a test tube corresponding to the condition in FIG. 4A.

FIG. 4A shows the simulated solute concentration distributions $C_i$ at the inception of centrifugation. Both DNA (20,22) and CsCl 24 are uniformly distributed in the centrifuge tube 11 at the beginning of a run as illustrated in FIG. 4B. Therefore, the meniscus is the left band edge (30,46) for both DNA solutes.

Figure 5A:
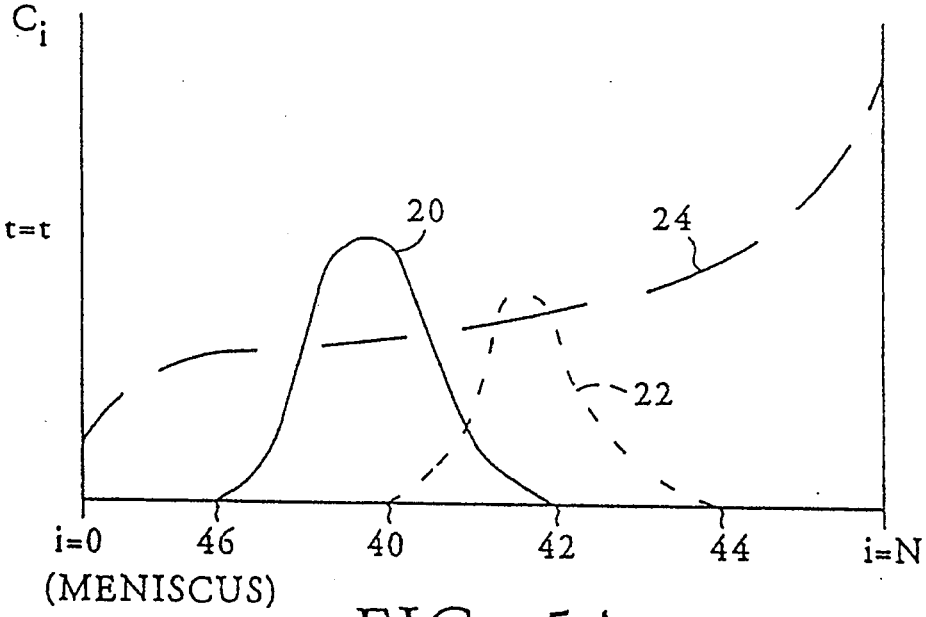
FIG. 5A is a plot illustrating the simulated concentration distributions of the sample solutes and CsCl at a point in time during centrifugation.
Figure 5B:
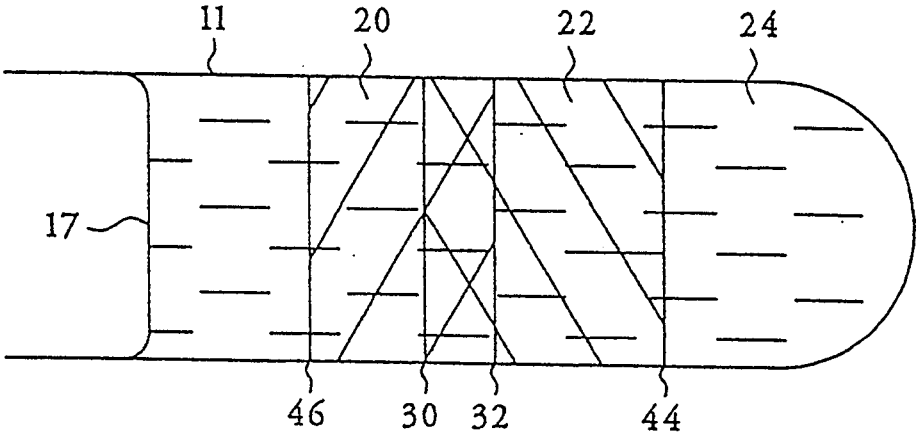
FIG. 5B is a schematic illustration of the appearance of a test tube corresponding to the condition in FIG. 5A.

FIG. 5A shows the simulated concentration distributions $C_i$ at time=t after the start of centrifugation. FIG. 5B illustrates the appearance of the solutes in the tube 11. The CsCl solution 24 gradually forms a density gradient. The more dense circular DNA solutes 22 pellet down the tube 11 (in right direction) and the less dense non-circular DNA solutes 20 float towards the top of the tube (in left direction). The circular DNA solutes 22 and non-circular DNA solutes 20 have grouped into bands each having a solute concentration distribution as shown in FIG. 5A. As illustrated in FIG. 5B, for each solute band, its left edge moved towards the tube bottom and right edge moved away from the tube bottom. Also, the left edge 30 of the denser solute band 22 and the right edge 32 of the less dense solute band 20 moved towards each other. The bands overlap in that the left edge 30 of the circular DNA solute band 22 or end point 40 of the concentration distribution (FIG. 5A) is present within the adjacent non-circular DNA solute band 30 or concentration distribution (see FIG. 5A), and the right edge 32 of the non-circular DNA solute band 20 or end point 42 of the concentration distribution is present within the adjacent circular DNA solute band 22 or concentration distribution (see FIG. 5A).

Figure 6A:
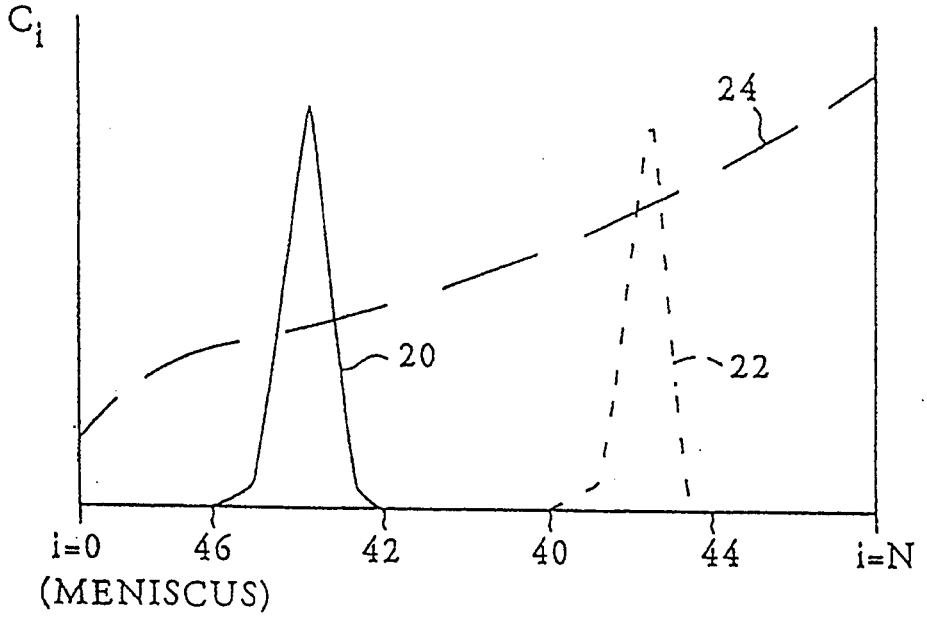
FIG. 6A is a plot illustrating the simulated concentration distributions of the solutes and CsCl at the completion of centrifugation (equilibrium)
Figure 6B:
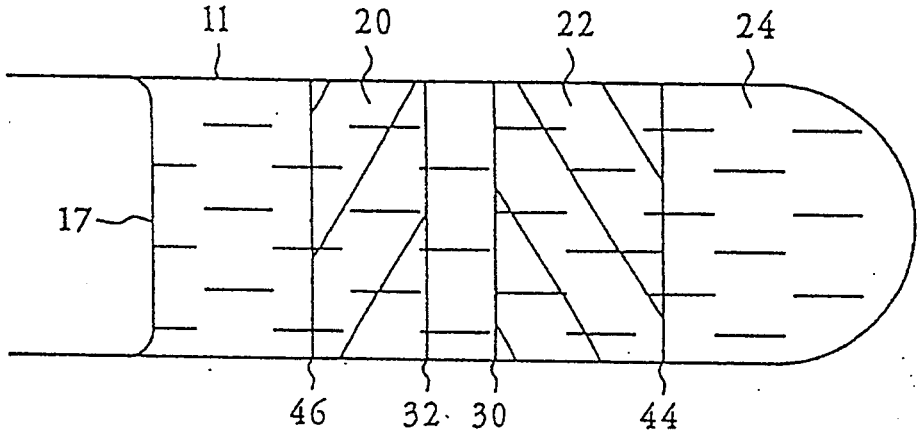
FIG. 6B is a schematic illustration of the appearance of a test tube corresponding to the condition in FIG. 6A.

FIG. 6A shows the simulated concentration distributions $C_i$ at close to equilibrium conditions, i.e. asymptotically approaching equilibrium distribution. FIG. 6B illustrates the appearance of the contents in the tube 11. The CsCl solution 24 has completely formed a monotonically increasing gradient towards the tube bottom (FIG. 6A). The bands 20 and 22 are completely separated with no overlap of the bands or concentration distributions. In other words, the left end point 40 of the distribution corresponding to the denser circular DNA solute 22 is to the right (closer to the tube bottom) of the right end point 42 of the distribution corresponding to the less dense non-circular DNA solute 20.

The positions of the end points of the concentration distributions are determined numerically from the flux calculation described previously to facilitate resolving spatial changes of the concentration distribution. The position of an end point or band edge is characterized by a specific location along the centrifuge tube where an imaginary boundary exists at which no more than a specific % of the total mass of the solute in the band lies outside said boundary. For example, a solute band at a particular time in the numerical integration may be defined as the tube volume that contains 99% of a solute; the left band edge or the concentration distribution end point of the particular solute band is defined as the radial location at which no more than 0.5% of the total mass of the solute lies to the left. The right band edge or concentration distribution end point is similarly defined as the location at which no more than 0.5% of the total solute mass lies to the right. For example, in FIG. 4A, since no more than 0.5% (and, in fact, precisely 0%) of the solutes lie to the left of the meniscus, the meniscus is the left band edge of both DNA solutes. It is noted that the % value given above are only intended as an example. Other % values may be acceptable depending on the computational resolution desired as well as limited by hardware and software constraints.

The criteria by which centrifugation is deemed to be completed may be one or more of the following depending on the particular centrifugation methodology chosen: (a) substantially no change in the position of the individual end points (40, 42, 44, 46; FIG. 6A) between successive checks; (b) substantially no change in the width of the concentration distribution between successive checks, i.e. distance between the end points of a concentration distribution (e.g. between 46 and 42, FIG. 6A); and (c) substantially no change in the distance between adjacent end points of adjacent sample solute concentration distributions between successive checks, e.g. between 42 and 40, FIG. 6A. Using one or more of these criteria, the computer can decide uniquely whether two sample solutes (e.g. circular DNA and non-circular DNA) have undergone complete separation.

More specifically, the ultimate test for asymptotically approaching "equilibrium" or completion of separation is criteria (a) which requires that there be substantially no change (within computation resolution) in the position of the end points (40, 42, 44, 46; FIG. 6A) of the sample solute concentration distributions of the DNA solutes 20 and 22 between successive checks. When this criterion has been met, the solute bands are essentially stationary in the centrifuge tube. More than two successive checks of the concentration distributions may be desirable to avoid a false decision based on only two successive checks as there might be a momentary indication of no-change status caused by the position resolution of the slices (see FIG. 1).

The other two criteria (b) and (c) are less restrictive than criterion (a) with regards to completion of centrifugation separation. Regarding criteria (b), even when this criterion has been met, i.e. the widths of the solute bands remain essentially constant between successive checks of the concentration distribution, the bands might be moving relative to each other and/or moving along the centrifuge tube. Regarding criteria (c), even when this criterion has been met, i.e. the spacing between the bands are essentially constant between successive analyses, the bands might be moving along the tube at constant spacing.

It has been observed that even in the most highly non-equilibrium concentration distributions, motion of the band edges in the discretized space is slow, characterized by minutes and hours. Moreover, the left edges of the sample solutes 20 and 22 remain at the meniscus (i=0) in spite of the decrease in concentration. There is no apparent movement of the edges until the sample solute concentration decreases to zero at the meniscus. Also, it was clear that the speed of the moving band edge for one size of DNA plasmid might be very different from that of another size of DNA plasmid. Therefore an excessively frequent check of the location of the band edges could result in a mistaken call of "equilibrium". This would occur when the time scale of motion of the edges was much longer than the inadvertently chosen short time scale of the edge location checks.

In order to avoid this, before running a simulation of the separation, it is necessary to at least roughly estimate the length of time required for the practical attainment of separation (see FIG. 2A). Subsequently, one can perform checks at time intervals that are some fixed fraction (e.g. 10%) of the estimated separation time (see FIG.2B). Specifically, a zeroth-order estimate is provided of an appropriate periodicity between successive checks of solute concentration distributions. This estimate is dependent on the rotation speed of the centrifuge rotor, effective radius of the solute from the spin axis, and the sedimentation coefficient of the solutes.

More particularly, the estimate is based on the sedimentation coefficient of the plasmids in water. The speed v of sedimentation of a plasmid particle (circular or non-circular DNA) with sedimentation coefficient s is given by s times the centripetal acceleration:

$$v = sW^2 r$$

where r in this equation is the distance of the sedimenting particle from the rotor spin axis and W is the angular speed of the rotor. The average sedimentation speed in water can thus be estimated by substituting the average value of r into the above equation:

$$\text{average } v = sW^2(r_{max}+r_{min})/2$$

where $r_{max}$ and $r_{min}$ are the radii of the outer (tube bottom) and inner (meniscus) boundaries of the tube, respectively. The approximate separation time is found by dividing the characteristic sedimentation distance, which is $(r_{max}-r_{min})$, by the average speed found above. The factor of 2 may be ignored as this is an order of magnitude estimate of the simulated separation time, T , the final estimate of which is hence:

$$T=(r_{max}-r_{min})/sW^2(r_{max}+r_{min})$$

In this estimate, W is taken to be the initial (maximum) angular velocity of the rotor, $W_y$, a speed that is based only on considerations of rotor stress level design limits. It is noted that T is therefore a lower bound estimate of the simulated time required for a band to form in the centrifuge tube. It has been empirically determined that a status check interval $\Delta t_s$ for the band edges or concentration distributions of T/6 or T/5 would be adequate. As shown in the flow-diagram in FIG. 2A, during the numerical integration for determination of solute flux for the CsCl and DNA plasmids, a status check of the band edges takes place at fixed intervals $\Delta t_s$ of simulated time.

Figure 7:
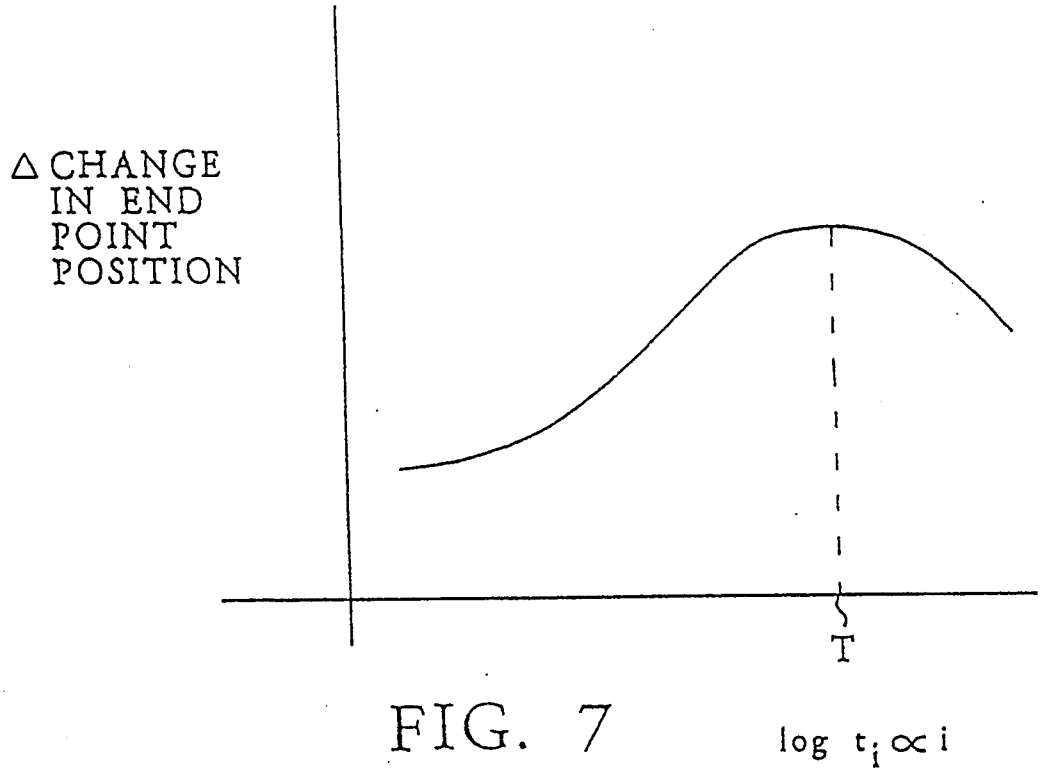
FIG. 7 is a plot of incremental change in the location of the band edge versus logarithm time scale for obtaining an order of magnitude estimate of the time scale of separation and stop criterion check interval.

An alternative scheme to estimate the status check interval may be implemented. In this implementation, the well-established simulated change in one type of solute of the sample (circular or non-circular DNA), i.e. concentration distribution end points or band edge, is examined periodically at times that are equally spaced in the logarithm of time. For example, checks may be made at $t_1=1$ minutes after the start of simulation centrifugation run (t=0), then at $t_2=2$ minutes, $t_3=4$ minutes, $t_4=8$ minutes, ... $t_i=2^{i-1}$..., up to some user determined maximum i that is practical for the duration of the particular type of run (e.g. i=14 gives a maximum $t=2^{13}=8192$ minutes=5 days!). Referring to FIG. 7, a plot of the incremental change in the location of the band edge of the solutes versus logarithm time scale would then reveal the time scale over which separation occurs. Specifically, little or no change would occur during the shortest intervals since significant sedimentation does not occur over a few minutes, nor during the longest intervals since at some point the change is expected to be none as the system will have reached equilibrium. All changes will occur between these time extremes and can be detected with less than or equal to, for example, only 14 measurements. While the plot does not gives an accurate indication of the time of centrifugation run completion, the abscissa for the peak of the plot however gives the order of magnitude estimate of the time scale of the separation T, about one-tenth of which (0.1T) can then be assigned as the stop-criterion status check interval $\Delta t_s$.

The foregoing scheme very quickly estimates the status check interval for use in determining centrifugation completion by simulation. The entire scheme can be carried out automatically. Once the status check interval has been determined, it applies to all centrifugation runs involving similar (on the same order of magnitude) conditions (i.e. rotor, sample, gradient material, rotation speed, etc.).

It can be appreciated that the method of the present invention provides complete automation in determining time of completion of centrifugation. The duration of centrifugation my be predicted through computer simulation and programmed into the control systems of centrifuges, for example, the Optima TM series ultracentrifuges developed and manufactured by Beckman Instruments, Inc. Alternatively, the centrifuge may be controlled during "real-time" calculation of the centrifuge stop criteria.

Figure 8:
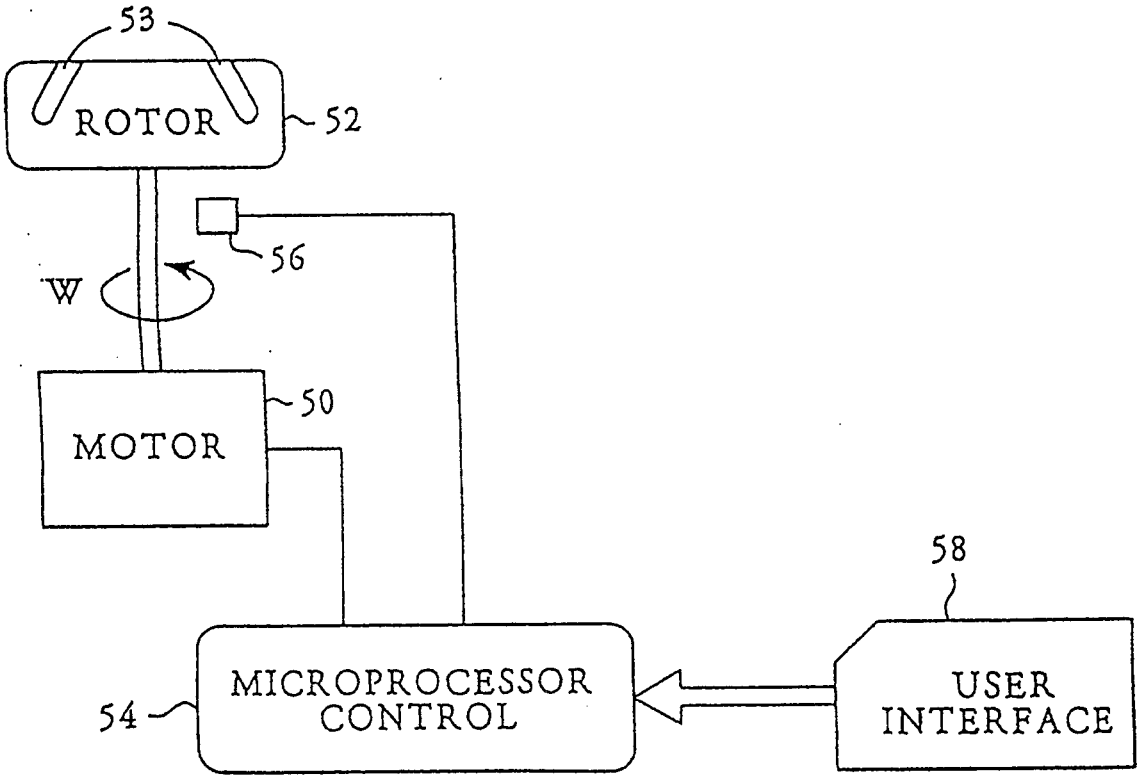
FIG. 8 is a schematic diagram of a rotor and speed controller.

A schematic diagram of the control system of the centrifuge is shown in FIG. 8. A variable speed motor 50 drives the rotor 52 which supports centrifuge tubes 53 containing samples for rotation within the chassis (not shown) of the centrifuge. (What is schematically shown is a fixed angle rotor, as an alternative embodiment to swinging bucket rotor.) The speed of the motor 50 is controlled by a microprocessor controller 54 in accordance with the technique heretofore described. A speed sensor 56 provided feedback of the rotor speed to the controller 54. Relevant input data such as initial concentration profile, constants and tube geometry are input through user interface 58.

The present invention is not limited to a particular type of rotor or centrifuge tube. Any combination of rotor, centrifuge tube, loading configuration of the density gradient solution can be simulated and controlled using the method of the present invention.

The thickness and the boundary area may be different for each slice for tubes with special geometry. To improve the resolution and accuracy of the process, the time interval $\Delta t$ between each iteration may be different for different rotors and/or different time segments in the process; for example it is preferred to have very small time intervals for the first few iterations to avoid singularities in the numerical integration.

It is noted that in the foregoing description of the method, the flux analysis begins at a given initial rotor speed. In an actual centrifugation run, however the rotor speeds up from rest to such "initial speed". However, the time taken to do this is negligible compared to the total run time and the transient sedimentation and diffusion flows during this start-up period are negligible. The start-up period therefore can be ignored to a good approximation. One can of course include flux analysis of the start-up period for marginal improvement in precision.

While the invention has been described with respect to the preferred embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

We claim:

1. A method of centrifuging comprising the steps of:

supporting a sample solution in a centrifuge, said sample solution having a first solute component therein;

centrifuging said sample solution at a time-dependent variable rotation speed about a rotational axis, said first solute component and said sample solution having a characteristic sedimentation and diffusion behavior that is a function of centrifugation speed and time;

simulating said sedimentation and diffusion behavior of said first solute component of said sample solution as a function of said time-dependent variable rotation speed, said simulating including computing at each of a first plurality of successive time intervals a spatial distribution of concentration of said first solute within said sample solution;

determining at each of a second plurality of successive time intervals a first predicted location representing the position of each of a first pair of solute band-edges in said spatial distribution, the entire volume therebetween containing a specified percentage of the total mass of said first solute;

ascertaining a run completion time based upon said first predicted location remaining constant for successive time intervals of said second plurality of time intervals; and stopping said centrifuging after an amount of time based upon said run completion time has elapsed.

2. The method of claim 1 wherein said step of ascertaining said run completion time includes detecting when said predicted locations of said first band-edges have not substantially changed during at least two time intervals of said second plurality of successive time intervals.

3. The method of claim 1 wherein said pair of band-edges has a distance therebetween and said step of ascertaining said run completion time includes detecting when said distance has not substantially changed during at least two time intervals of said second plurality of successive time intervals.

4. The method of claim 1 further comprising selecting time intervals of said second plurality of time intervals having greater duration than time intervals of said first plurality of time intervals.

5. The method of claim 1 wherein said supported sample solution has a second solute component therein, said method further comprising the steps of: computing at each of said first plurality of successive time intervals a spatial distribution of concentration of said second solute; and determining at each of said second plurality of successive time intervals, a second predicted location representing the position of a second pair of solute band-edges between which a specified percentage of the total mass of said second solute is located; and ascertaining a run completion time based upon both said first and said second predicted locations remaining constant for successive time intervals of said second plurality of time intervals.

6. The method of claim 5 wherein said step of ascertaining said run completion time includes detecting when the distance between adjacent band-edges of said first and second pairs of band-edges remains substantially constant during at least two time intervals of said second plurality of time intervals.

7. The method of claim 5 wherein said step of computing said spatial distribution of concentrations for each of said first and second solutes occurs at equal intervals of time.

8. The method of claim 7 wherein said step of determining said locations of each of said first and second pairs of band-edges occurs at successively increasing intervals of time.

* * * * *